US006430857B1

(12) United States Patent
Nagel

(10) Patent No.: US 6,430,857 B1
(45) Date of Patent: Aug. 13, 2002

(54) EXTRUDED LABEL HOLDER

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 09/637,072

(22) Filed: Aug. 11, 2000

(51) Int. Cl.[7] ..... G09F 3/20
(52) U.S. Cl. ..... 40/661; 40/649; 40/642.02
(58) Field of Search ..... 40/661, 661.08, 40/661.03, 642.02, 649, FOR 101

(56) References Cited

U.S. PATENT DOCUMENTS

| | | | |
|---|---|---|---|
| 4,745,695 | A | 5/1988 | Hetzer |
| 5,197,215 | A | 3/1993 | Torsleff |
| 5,348,167 | A | 9/1994 | Jensen |
| 5,442,872 | A | 8/1995 | Moser |
| 5,456,034 | A | 10/1995 | Lewis et al. |
| 5,702,008 | A | 12/1997 | Thalenfeld et al. |
| 5,815,970 | A | 10/1998 | Thalenfeld et al. |
| 5,826,359 | A | 10/1998 | Thalenfeld et al. |
| 5,860,239 | A | 1/1999 | Thalenfeld et al. |
| 5,887,731 | A | 3/1999 | Thalenfeld et al. |
| 6,141,894 | A | 11/2000 | Thalenfeld et al. |

FOREIGN PATENT DOCUMENTS

| | | | |
|---|---|---|---|
| DE | 3513199 | * 10/1986 | ..... 40/FOR 101 |
| DE | 3515474 | * 10/1986 | ..... 40/FOR 101 |
| EP | 158337 | * 10/1985 | ..... 40/FOR 101 |

* cited by examiner

*Primary Examiner*—Cassandra H. Davis
(74) *Attorney, Agent, or Firm*—Schweitzer Cornman Gross & Bondell LLP

(57) ABSTRACT

A label holding strip is formed of extruded plastic material, with front and back panels joined integrally along the bottom region of said strip to form an upwardly opening pocket for the reception of labels. The upper portions of the panels are of a generally uniform thickness, while the bottom region of the strip, preferably in the form of a forwardly projecting lobe, is of a significantly (20% or more) greater thickness. A smooth transition region joins the thinner and thicker portions of the strip. The front and rear panels, in the lower portions, are spaced apart a distance not less that the thickness of labels intended to be inserted therein. Upper portions of one of the panels, typically the front panel, curve toward the other panel for gripping a label inserted in the pocket.

4 Claims, 3 Drawing Sheets

EXTRUDED LABEL HOLDER

BACKGROUND AND SUMMARY OF THE INVENTION

The present invention is directed to label holder devices, such as are mounted at the front edge of merchandise display shelving, at the outer ends of merchandise display hooks, etc., in order to display labels containing pricing and other product information.

A known and advantageous form of label holder is comprised of a continuous extrusion of plastic material which is configured to form front and back panels, joined along bottom edge regions of each, typically by means of a forwardly projecting lobe, and forming an upwardly opening pocket for receiving labels. The front panel is formed of clear plastic material while the back panel frequently is formed of a colored, somewhat opaque material.

The present invention is directed to improvements in label holding devices of the general type described to make them more useful for the purposes intended and having a longer useful life. Label holding devices of the type contemplated are formed of a relatively rigid, although at least slightly flexible plastic material, frequently a rigid polyvinyl chloride. For inserting and removing labels, the front panel of the label holder is separated from the back panel, to provide access to the open top of the label holder, for placing and/or removing labels. Repeated accesses to the label holder often result in cracking and/or breakage because of stresses imposed at the flexing area of the label holder. Pursuant to one aspect of the present invention, an improved cross sectional configuration is provided for the label holder, which involves a significant increase in the thickness of the walls of the label holder, in a bottom region thereof, including the entire lobe area and lower portions of the front and back panels immediately above the lobe. The front and back panels, which are principally of uniform thickness in their upper portions, undergo a smooth transition from the relatively uniform thickness of the upper panel portions, to the significantly greater thickness of the bottom lobe area. The arrangement is such that the stresses of repeated accesses to the label holder are distributed over a relatively large region of the cross section", rather than being concentrated in any particular region.

According to another feature of the invention, the spacing between front and back panels of the label holder in the region of the lobe is at least as great as the thickness of the labels intended to be received in the label holder. Upper portions of the front panel, for example the upper 30% thereof, are gradually curved back toward, and preferably substantially into contact with the back panel. With this arrangement, labels may be easily inserted and removed from the label holder. At the same time, upper portions of the label are reliably gripped by upper portions of the front and back panels.

For a more complete understanding of the above and other features and advantages of the invention, reference should be made to the following detailed description of preferred embodiment, and to the accompanying drawings.

DESCRIPTION OF PREFERRED EMBODIMENTS

Figure 1:
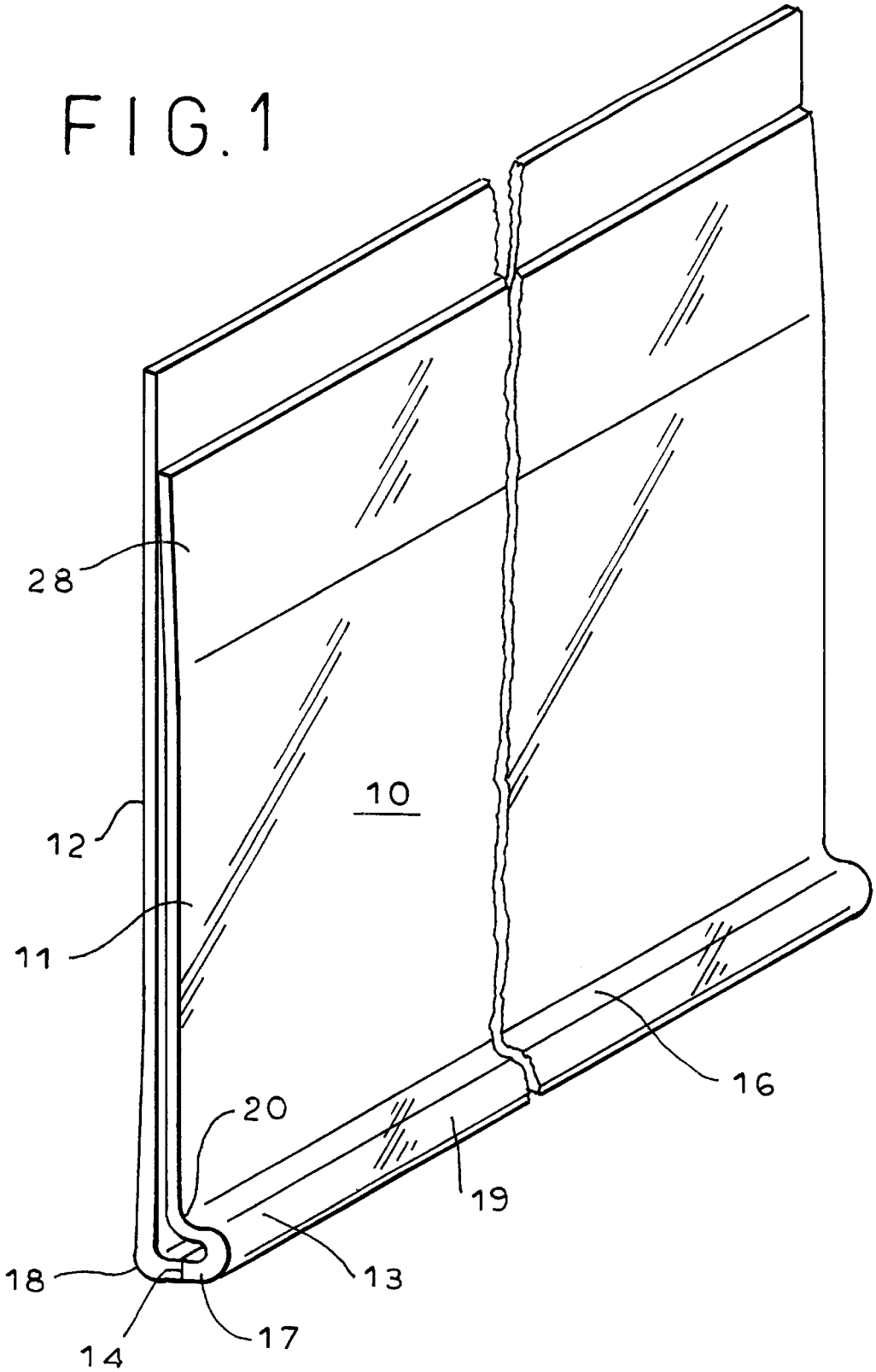
FIG. 1 is a front perspective view of a label holder incorporating features of the invention.
Figure 2:
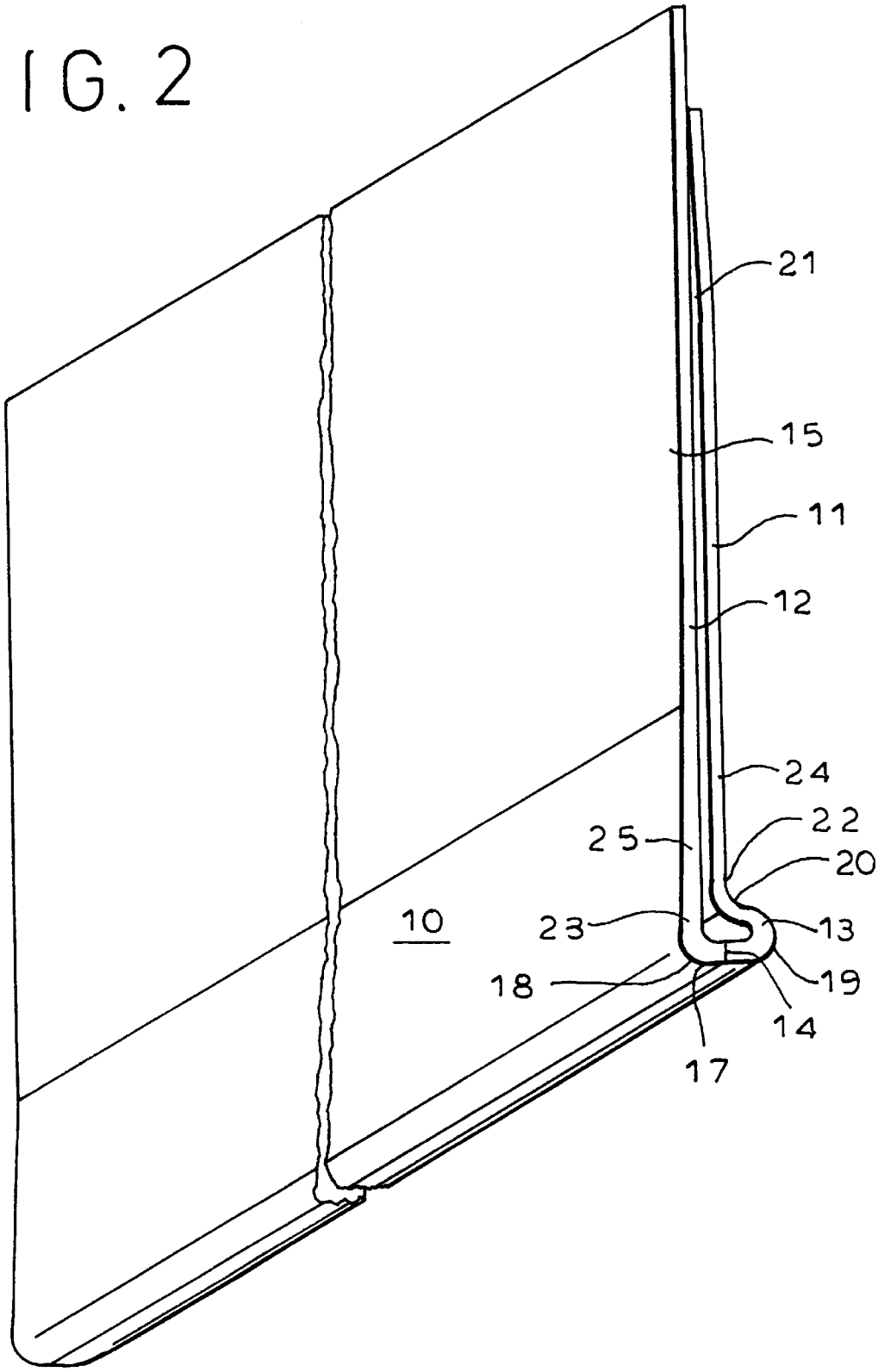
FIG. 2 is a back perspective view of the label holder of FIG. 1.

Referring now to the drawing, the reference numeral 10 designates generally the label holder of the invention, it is formed by extrusion of plastic material, typically rigid polyvinyl chloride. The configuration of the extrusion forms a front panel 11, a back panel 12, and a bottom lobe 13 joining the front and back panels. The front panel is formed of a transparent material. The back panel 12 may also be formed of transparent material, but is more typically formed of a colored, usually opaque material. The materials of the front and back panel are merged typically at a line 14, typically positioned in the lobe area so as to be not readily visible from the front of the label holder. The back panel 12 is provided with suitable means for mounting the label holder in a visible position for displaying a label. In one simple form of the device, the back panel may be provided with an adhesive layer 15 for attachment to the front edge of a display shelf (not shown). However, as those skilled in the art are well aware, additional panels, clips or the like may be provided at the back of the label holder for mounting the holder in an existing price channel, for example, or on a display hook.

Where the label holder is to be mounted on display shelving, the label holder may be of considerable length. Four feet would be typical. In some instances, the label holder may be used in connection with individual merchandise display hooks, in which case the label holder would have a length of only a few inches, and would incorporate a clip or the like (not shown) for attaching the label holder to the merchandise display hook.

In a typical and advantageous embodiment of the invention, the label holder might have an overall height of, for example, 1.25–1.50 inches, with the front panel 11 being slightly less elevated than the back panel 12, as is evident in FIG. 1. Typical wall thickness for the panels 11, 12 might be approximately 0.025 inch.

In the illustrated form of the invention, the front and back panels 11, 12 are joined at their lower edges by means of the lobe 13, which projects forward from the front panel 11 and forms an upwardly facing flange surface 16. In a typical embodiment, the lobe 13 includes a bottom wall 17 which joins the back panel 12 along a corner radius 18. The front edge of the bottom wall joins a front surface portion 19 of generally U-shaped cross section, which joins the lower edge of the front panel 11 along a radiused corner 20. The upper arm of the U-shaped portion forms the flange surface 16.

Figure 3:
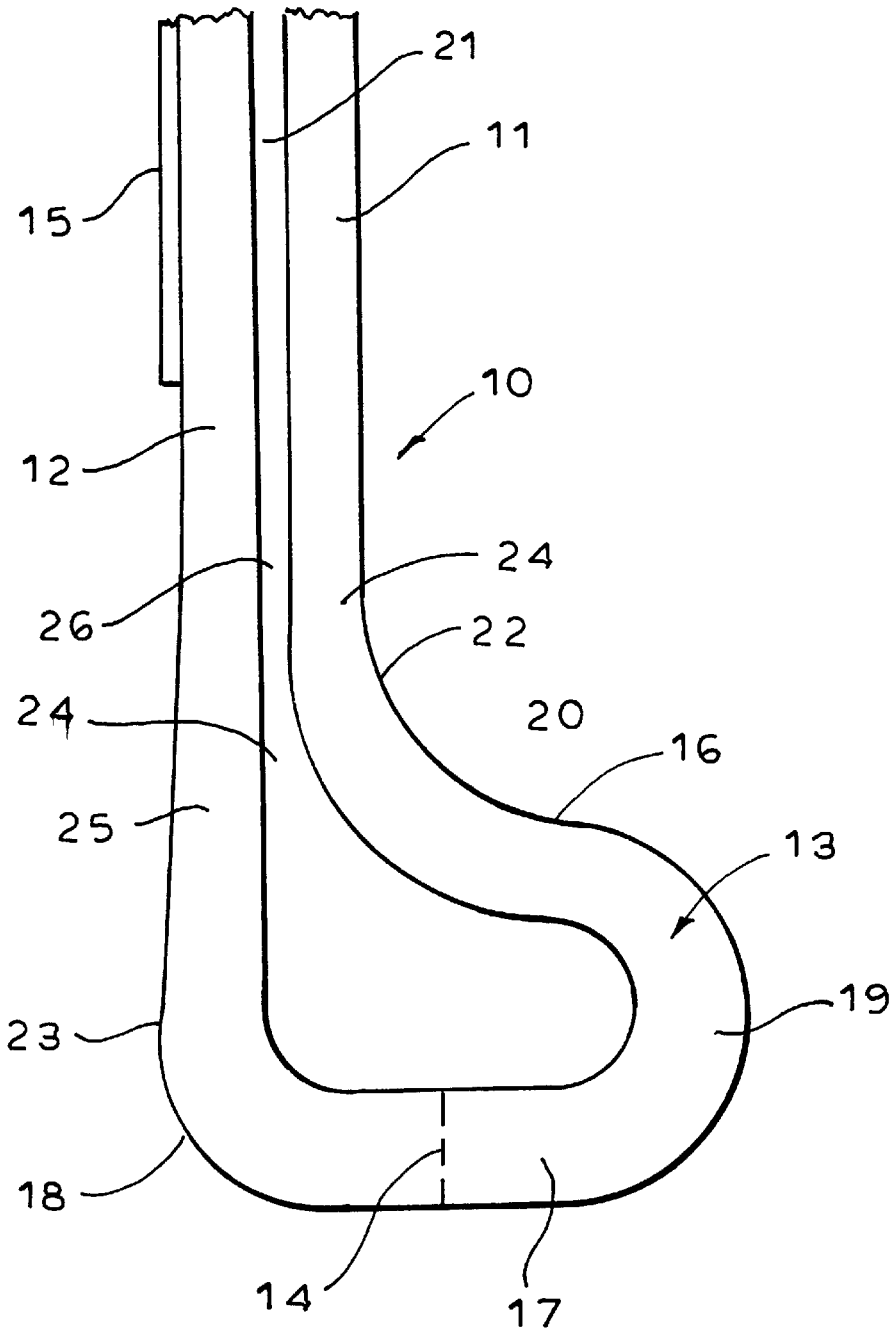
FIG. 3 is an enlarged, fragmentary end elevational view of the label holder of FIG. 1.

The arrangement of front and back panels 11, 12, joined integrally along their bottom edges by the forwardly projecting lobe 13, defines an upwardly opening pocket 21 for the reception of a thin paper label containing pricing and other information related to the product displayed in the vicinity of the label. The label pocket 21 is accessed by displacing the front panel 11 outwardly a distance sufficient to allow the label to be manually inserted. Likewise, a label already installed in the label holder can be engaged manually and Repeated accesses to the label receiving pocket 21, for the purpose of inserting and/or removing labels, results in stressing of the label holder in the region in which the front and back panels are joined, sometimes causing cracking in the stress area and requiring premature replacement of the label holder. Pursuant to the invention, modifications have been made in the cross sectional configuration of the label holder extrusion, to provide for a significant (at least about 20%) increase in the wall thickness of the extrusion in the bottom region of the lobe holder. Additionally, transition zones are provided, for the smooth transition of the wall thickness from the "standard" thickness of the upper portions of the front and back panels, to the increased thickness of the lower regions. The resulting arrangement provides that stresses placed upon the label holder during accessing of the pocket 21 are distributed over a wide area, of the bottom region, and not concentrated in any particular location. In the illustrated embodiment of the invention, as shown particularly in FIG. 3, the entire lower portion of the label holder, commencing at a point 22 at the bottom of the front panel 11, and extending over the entire cross section of the lobe 13 to a point 23 at the bottom edge of the back panel 12, is of a thickness at least about 20% greater than the principal wall thickness of the upper portions of the front and back panels, and preferably in the range of 20–35% greater thickness. Above the indicated points 22, 23, the wall thickness of the panels 11, 12 is caused to taper gradually from the increased thickness of the lower area to the standard thickness of the front and back panels.

With the device of the invention, when the front panel 11 is engaged and drawn forwardly to open the label-receiving pocket 21 for access, the deflection stresses imposed upon the lower extremities of the label holder are caused to be distributed in a somewhat uniform manner over the entire area starting from the transition areas 24, 25 and extending throughout the entire lobe area. By avoiding concentrated stresses, the functioning life of the label holder can be greatly extended. This results in significant savings to the merchandiser in that, not only is the cost of a replacement label holder avoided, but probably more importantly also the labor cost of removing the damaged label holder and installing the new one.

In accordance with another feature of the invention, the internal configuration of the label holder is optimized to improve the appearance of the display, while providing for effective gripping of the labels when installed. To this end, the spacing 26 between the back panels 11, 12, adjacent their lower edges (see FIG. 3) is at least equal to the thickness of the label which is intended to be received therein. This assures that, after the label has been inserted and the displacement forces holding the label holder open have been released, the upper portions of the front panel will not be displaced excessively to an open position by the presence of the label 27 between the lower portions of the front and back panels. In conjunction with the provision of such minimum spacing in the lower portions of the label holder, the upper portions 28 of the front panel, typically approximately the upper 30% margin thereof, is configured to curve gradually rearwardly, preferably into a position contacting the front surface of the back panel 12, when no label or other object is interposed between the front and back panels. This arrangement assures upper portions of the label will be firmly gripped between the front and back panels, after a label has been inserted therein, and also assures a neat and attractive appearing label display, which enhances the store owner's effort to create an attractive display of the related merchandise.

With the label holder of the invention, substantial enhancements are realized in the performance of the device, with cost savings realized by the store owner from reduced maintenance and replacement requirements. These improvements are realized with little if any additional cost of manufacture. The negligibly greater amount of plastic material required in the initial extrusion represents a negligible added cost in the manufacturing process, and is far more than offset by the savings realized by reduction in the frequency of replacement required in the field.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A label holding strip for displaying price and information labels in association with merchandise displays, which comprises, (a) a continuously extruded section of plastic material including front and back panels joined integrally along a bottom edge region of said strip and forming an upwardly opening pocket for the removable reception of labels, (b) upper portions of said front and back panels being formed primarily of a predetermined substantially uniform thickness of plastic material, (c) lower portions of said front and back panels, and said bottom edge region, being of greater thickness than said uniform thickness, (d) each of said front and back panels being formed with transition regions in which the thickness of said panels increases smoothly from said predetermined substantially uniform thickness to said greater thickness, (e) said greater thickness is at least about 20% greater than said predetermined substantially uniform thickness.

2. A label holding strip according to claim 1, wherein (a) said bottom edge region comprises a forwardly projecting lobe including (i) a generally horizontal bottom panel extending forward from said back panel, and (ii) an upper flange-forming panel joined along forward portions thereof with forward portions of said bottom panel and along back portions thereof with said front panel, (b) said portions of greater thickness including all of said bottom edge region and limited lower portions of said front and back panels above and adjacent thereto.

3. A label holding strip according to claim 1, wherein (a) said label holding strip is designed for holding a label having a thickness not greater than a predetermined label thickness, (b) said front and back panels, in a region thereof immediately above said bottom region, being spaced apart a distance at least as great as said predetermined label thickness, and (c) said front panel, adjacent an upper edge thereof, being curved inwardly substantially into contact with said back panel.

4. A label holding strip according to claim 1 wherein (a) said greater thickness is at least about 20% to 35% greater than said predetermined substantially uniform thickness.

* * * * *